US011311161B2

(12) United States Patent
Noehr Larsen et al.

(10) Patent No.: US 11,311,161 B2
(45) Date of Patent: Apr. 26, 2022

(54) DIRT COLLECTING DEVICE FOR A CLEANING DEVICE, PARTICULARLY A SWEEPING VEHICLE, AND VACUUM CLEANER NOZZLE FOR A VACUUM CLEANER, AND METHOD FOR OPERATING BOTH DEVICES

(71) Applicant: Nilfisk A/S, Broendby (DK)

(72) Inventors: Peter Noehr Larsen, Kopenhagen (DK); Martin Walters Schmidt, Kopenhagen (DK)

(73) Assignee: NILFISK A/S, Broendby (DK)

( * ) Notice: Subject to any disclaimer, the term of this patent is extended or adjusted under 35 U.S.C. 154(b) by 0 days.

(21) Appl. No.: 15/561,999

(22) PCT Filed: Mar. 23, 2016

(86) PCT No.: PCT/EP2016/000505
§ 371 (c)(1),
(2) Date: Sep. 27, 2017

(87) PCT Pub. No.: WO2016/155872
PCT Pub. Date: Oct. 6, 2016

(65) Prior Publication Data

US 2018/0055316 A1 Mar. 1, 2018

(30) Foreign Application Priority Data

Mar. 27, 2015 (DE) ..... 10 2015 003 916.4

(51) Int. Cl.
*A47L 9/14* (2006.01)
*A47L 9/10* (2006.01)
(Continued)

(52) U.S. Cl.
CPC ..... *A47L 9/1409* (2013.01); *A47L 5/30* (2013.01); *A47L 9/0081* (2013.01);
(Continued)

(58) Field of Classification Search
CPC .. A47L 9/066; A47L 11/4058; A47L 11/4019; A47L 9/14; A47L 9/2842;
(Continued)

(56) References Cited

U.S. PATENT DOCUMENTS 3,491,399 A * 1/1970 Burgoon ..... A47L 7/00 15/351
4,654,924 A * 4/1987 Getz ..... A47L 9/0411 15/319
(Continued)

FOREIGN PATENT DOCUMENTS

CN 202665455 U 1/2013
DE 1235971 B * 3/1967 ..... A47L 9/14
(Continued)

*Primary Examiner* — Bryan R Muller
(74) *Attorney, Agent, or Firm* — Browdy and Neimark, PLLC

(57) ABSTRACT

Method for operating a dirt collecting device for a sweeping vehicle or for a vacuum cleaner nozzle of a floor or upright vacuum cleaner, which each comprise a suction fan with controllable speed and/or power, wherein in a first method step, the suction power of the suction fan is set at such a low level that the suction pressure in the dirt collecting device or the vacuum cleaner nozzle is merely sufficient to convey and deposit the absorbed coarse dirt into the intermediate container, and to convey the absorbed fine dirt into a downstream collection container, (normal operation); and that in a second method step, the filling level in the intermediate container is detected with respect to the coarse dirt deposited therein; and that in a third method step, if the filling level in the intermediate container is exceeded, the suction power of the suction fan is increased such that the coarse dirt, which is temporarily deposited in the intermediate container, becomes dispersible and is conveyed into the downstream collection container (emptying mode).

12 Claims, 11 Drawing Sheets

(51) Int. Cl.

| | |
|---|---|
| ***A47L 9/28*** | (2006.01) |
| ***A47L 11/40*** | (2006.01) |
| ***A47L 11/24*** | (2006.01) |
| ***E01H 1/08*** | (2006.01) |
| ***A47L 5/30*** | (2006.01) |
| ***A47L 9/00*** | (2006.01) |
| ***A47L 9/04*** | (2006.01) |

(52) U.S. Cl.
CPC ..... *A47L 9/0411* (2013.01); *A47L 9/0477* (2013.01); *A47L 9/106* (2013.01); *A47L 9/2821* (2013.01); *A47L 9/2842* (2013.01); *A47L 11/24* (2013.01); *A47L 11/403* (2013.01); *A47L 11/4013* (2013.01); *A47L 11/4027* (2013.01); *A47L 11/4041* (2013.01); *E01H 1/0854* (2013.01); *E01H 1/0845* (2013.01)

(58) Field of Classification Search
CPC ..... A47L 9/1409; A47L 9/106; A47L 11/22; A47L 11/24
USPC ..... 15/416, 422, 418
See application file for complete search history.

(56) References Cited

U.S. PATENT DOCUMENTS

| | | | | |
|---|---|---|---|---|
| 5,018,240 | A * | 5/1991 | Holman | A47L 5/30 15/347 |
| 5,500,979 | A * | 3/1996 | Worwag | A47L 5/32 15/335 |
| 7,827,653 | B1 | 11/2010 | Liu | |
| 2007/0006417 | A1* | 1/2007 | Richardson | A47L 9/1472 15/347 |
| 2007/0101536 | A1* | 5/2007 | Nielsen | A47L 9/2857 15/351 |
| 2012/0199006 | A1* | 8/2012 | Swett | A47L 9/2805 96/417 |

FOREIGN PATENT DOCUMENTS

| | | | |
|---|---|---|---|
| DE | 1235971 | B | 3/1967 |
| DE | 1658383 | A1 | 11/1970 |
| DE | 3213089 | A1 | 12/1982 |
| DE | 4128879 | A1 | 3/1993 |
| DE | 4411526 | A | 10/1995 |
| DE | 4411526 | A1 | 10/1995 |
| DE | 19851666 | C1 | 9/2000 |
| DE | 19914574 | C1 | 11/2000 |
| DE | 10356419 | B3 | 6/2005 |
| EP | 2350393 | B1 | 10/2012 |
| WO | 2003007776 | A1 | 1/2003 |
| WO | 2010043406 | A1 | 4/2010 |

* cited by examiner

| | Power | Brush | Total |
|---|---|---|---|
| (Watt) high power | 3269 | 700 | 3969 |
| (Watt) low power | 480 | 700 | 1180 |

Fig. 14

| Time portion | Energy consumption |
|---|---|
| 0% | 3969 |
| 10% | 3690 |
| 20% | 3411 |
| 30% | 3132 |
| 40% | 2853 |
| 50% | 2575 |
| 60% | 2296 |
| 70% | 2017 |
| 80% | 1738 |
| 90% | 1459 |
| 100% | 1180 |

Fig. 15

DIRT COLLECTING DEVICE FOR A CLEANING DEVICE, PARTICULARLY A SWEEPING VEHICLE, AND VACUUM CLEANER NOZZLE FOR A VACUUM CLEANER, AND METHOD FOR OPERATING BOTH DEVICES

The invention relates to a dirt collecting device for a cleaning device, particularly a sweeping vehicle, and vacuum cleaner nozzle for a vacuum cleaner, and a method for operating both devices.

A dirt collecting device for a sweeping vehicle was, for example, described with the subject matter of DE 32 13 089 A1, or DE 103 56 419 B3, or DE 198 51 666 C1. Any and all embodiments and functions described therein are part of the present invention description. As a result, a dirt collecting device for a sweeping vehicle can only comprise a sweeper roller operated at the front and at the bottom, but can also comprise additional sweeper rollers in the front area as described in DE 32 13 089 A1 with reference sign 10.

The invention also relates to a vacuum cleaner nozzle for a floor or upright vacuum cleaner as it has become known with the subject matter of U.S. Pat. No. 5,500,979 A1. The contents of this document as well as the contents of the parallel DE 44 11 526 A1 are part of the present invention description. The cleaning of hard surfaces, such as streets or sidewalk surfaces, or also the cleaning of hard floors in the interior requires a suction device having an airflow with high power.

If a vacuum cleaner is used, a flow rate in the range of 30 to 40 liters per second is required for an effective cleaning of hard floors, which requires power in the range between 900 to 1500 watts for a connected suction fan.

However, for dirt collecting devices for road-worthy cleaning devices, particularly sweeping vehicles, an airflow in the range from 400 to 7001/s at a power of the suction fan in the range between 4 to 8 kW is required. The high volume flow is necessary in order to make possible an air speed between 15 to 30 m/s in the area of the dirt collecting device operated in the area near the floor. The sweeper roller arranged in the front area is used to remove coarse and fine dirt from the surface to be cleaned. The present invention claims both rotational directions of such a sweeper roller. Therefore, such a sweeper roller can operate according to the throw-over principle but also according to the throw-under principle.

There is a need to reduce the energy consumption of such cleaning machines with dirt collecting devices. Due to EU regulations, the power of suction fans is supposed to be generally delimited, and with regard to sweeping vehicles used on streets, the intention is that of operating such sweeping machines as environmentally friendly as possible, i.e. for example with battery operation, fuel cells, or hybrid drives consisting of an internal combustion engine and other auxiliary drives. Currently, diesel engines are predominantly used which have an undesirable high exhaust gas emission and generate a high noise level. Due to the required high power of the suction fan, high-volume diesel engines must thus be used.

Therefore, there is a need to use main engines for the suction fan and the drive engine with low fuel consumption and low weight at an increased range.

Using the example of the sweeping machine according to the subject matter of DE 198 51 666 C1, it can be illustrated that for the collection of coarse dirt, which in the area of street sweepers mainly consists of empty glass bottles, stones, and other heavy objects, a suction power of the suction fan in the range between 2 and 5 kW is required.

The known street sweepers with dirt collecting devices require that the power of the suction fan is operated without interruption at a maximum value in order to ensure that the coarse dirt collected by the sweeper roller in the form of empty glass bottles, heavy stones, and the like can be transported immediately to a coarse dirt collection container. For example, such a coarse dirt collection container is denoted with reference sign 6 in DE 198 51 666 C1. Therefore, a maximum suction pressure must always be maintained at the suction nosepiece in the area of the sweeper roller 5 in order to ensure that the coarse dirt is transported reliably to the elevated coarse dirt collection container. However, this is disadvantageous because the suction fan constantly operates at maximum conveying capacity, resulting in correspondingly high energy consumption and noise emission of such a sweeper.

Once the coarse dirt collection container according to DE 198 51 666 C1 is filled, it can be pulled out and must be emptied manually. Once it is reinserted, the sweeper can be operated again. Therefore, the operation of such a sweeper is only possible intermittently, i.e. the sweeper must occasionally stop and empty the coarse dirt collection container at a suitable place which causes difficulties in narrow road networks in big cities.

Similar circumstances apply accordingly to a vacuum cleaner nozzle according to the subject matter of U.S. Pat. No. 5,500,979 A1.

The brush roller used at the front is once again designed such that it must convey the coarse and fine dirt collected from the bottom side to a downstream container by means of an elevated conveyor line, which is linked to increased suction pressure and unwanted noise emission.

If the suction pressure from the suction fan used is not high enough at the brush roller, the brush roller is unable to convey the collected coarse dirt in the form of stones or other heavy non-dispersible objects to the downstream collection container.

Therefore, such vacuum cleaner nozzles are also disadvantageous because the power of the suction fan must always be selected at such a level that even heavy, collected objects can be made dispersible due to the applied suction pressure and conveyed into the downstream collection container, which results in high energy consumption and unwanted noise emission of the suction fan.

The invention therefore addresses the problem of further developing a method for operating a dirt collecting device for a cleaning vehicle, particularly a sweeping vehicle or a vacuum cleaner nozzle for a floor or an upright vacuum cleaner of the initially described type such that the suction fan used for that purpose operates with significantly less energy input and lower noise emission.

The problem addressed is solved by a device characterized by the subject matter of the device claims in this application, and both devices are operated by means of a method according to the method claims of this application.

Therefore, the feature of the invention is that both a dirt collecting device and a vacuum cleaner nozzle is proposed, in the housing of which—substantially on the same plane or only slightly elevated—relative to the plane on which the coarse or fine dirt to be input into the dirt collecting device is deposited, an intermediate container is arranged downstream which is intended for the temporary intermediate storage of temporarily non-dispersible coarse dirt.

Therefore, the invention provides that in the housing of the dirt collecting device for a cleaning device, particularly a sweeping vehicle, or in the housing of a vacuum cleaner nozzle, an intermediate container is integrated which lies in the airflow of the suction fan and which is intended to only accommodate the coarse dirt—which under the influence of the current decreased suction pressure is non-dispersible—while the fine dirt is immediately conveyed over said intermediate container—also under the influence of the decreased suction pressure—to a collection container provided on the side of the final storage.

If a cleaning device, particularly a sweeping vehicle having a dirt collecting device is used, it can be provided that the collection container provided on the side of the final storage can itself be divided. It can be formed from a coarse dirt container and a fine dirt container arranged downstream.

In a different embodiment, it is also possible that only one single container is arranged downstream which collects both coarse and fine dirt.

The concept of the invention is that of operating the suction fan in the cleaning device, particularly in the sweeping vehicle or the vacuum cleaner such that it merely operates at a decreased air speed, wherein, due to the decreased air speed, only minimum energy is consumed by the suction fan. Correspondingly, the noise level is also lowered.

Due to the decreased and thus lower air speed, only the rotatingly driven sweeper roller can pick up the fine dirt and the coarse dirt. The suction pressure is merely sufficient to fill the intermediate container, which is arranged essentially on the same plane or slightly elevated, with non-dispersible coarse dirt. The container is filled by means of the mechanical energy of the sweeper roller which is supported only slightly by the decreased suction pressure.

However, at the decreased suction pressure, the fine dirt is conveyed through (or over) said intermediate container and collected in a downstream collection container on the side of the final storage.

The result of halving the airflow in the area of the dirt collecting device for a sweeping vehicle or for a vacuum cleaner is that the suction fan used only requires a quarter of the energy usually required. For the most part of the operation of the dirt collecting device for a sweeping vehicle or the operation of a vacuum cleaner nozzle, the suction power is therefore greatly reduced (normal operation) because the decreased suction power is supposed to merely suffice to convey the input fine dirt to the collection container provided at the side of the final storage, while the input coarse dirt, which is non-dispersible due to the low air speed used, is collected in an intermediate container arranged in the housing of the dirt collecting device or the vacuum cleaner nozzle.

Therefore, during the most part of the cleaning, the airflow and the noise level are low and the energy consumption of the suction fan is reduced. Only when the intermediate container must be emptied, the airflow of the suction fan must be increased by a factor of 1.5 to 2 and correspondingly, the power of the fan must also be increased.

As a result, the suction fan only operates at maximum energy consumption for the purpose of emptying the intermediate container of coarse dirt, which now is dispersible due to the increased air speed, and for transporting it to the downstream collection container intended for final storage.

In this manner, a sweeping vehicle having the dirt collecting device according to the invention can remain in operation without interruption for a long period of time because it is not necessary to intermittently empty the coarse dirt collection container, as was the case in DE 198 51 66 C1.

The volume of the collection container provided at the side of the final storage is many times greater than the volume of the intermediate container, wherein a volume ratio of 1:5 is preferred.

One or more sensors are preferably arranged in the intermediate container, said sensors detecting the filling level of the coarse dirt. Such sensors can be either contactless (optical, ultrasound, inductive, capacitive) or also contacting for detecting the filling level in the intermediate container with suitable spring-loaded feelers.

The maximum power of the suction fan requires a specific air speed, which is also called transport speed, the magnitude of which depends on the weight and the dimensions of the deposits (coarse dirt) in the intermediate container.

Preferably, the dirt collecting device used (including the front spoiler) is closed on all sides in the direction of the roadway plane, having a nozzle-like tapered receiving opening in order to further increase the air speed in this area. This allows for a high suction power for the coarse dirt deposited on the road surface.

In case of a sweeper, the surface of the dirt collecting device for a sweeping vehicle located in the suction airflow of the suction fan should lie between 20 to $100\times10^{-3}$ m2. For a vacuum cleaner nozzle, the surface should be in a range between 1 to $5\times10^{-3}$ m2.

The width of the front side nozzle should be less than 50% of the width of the cleaning machine in order to allow for the dirt collection in the front area at high air speeds to be as effective as possible.

The integration of the intermediate container in the dirt collecting device or the vacuum cleaner nozzle is advantageous because only a low airflow is required for conveying the dirt from the floor plane into the dirt collecting device or vacuum cleaner nozzle, since the largest share at this activity is executed by the rotatably driven sweeper roller (of a cleaning vehicle) or the brush roller (of a vacuum cleaner nozzle).

Tests have shown that an airflow in the range of approximately only 260 l/s is required to achieve a successful filling of the intermediate container for a dirt collecting device in a sweeping vehicle.

Therefore, the dirt collecting device for a sweeping vehicle with a reduced suction power of the suction fan in the range of 260 l/s is used for the larger part of the operating time. Once the intermediate container is filled, the airflow is increased, e.g. to 520 l/s in order to empty the intermediate container of coarse dirt. Due to the increased airflow, the coarse dirt becomes dispersible.

All values specified herein must be understood as exemplary and are supposed to merely indicate the dimensions used. They do not limit the inventive concept.

The filling level sensor arranged in the intermediate container thus controls the power of the suction fan. Alternatively, it is also possible to provide a control device, with which the power of the suction fan is controlled on the basis of the filling level in the intermediate container.

Once the intermediate container is emptied, the power of the suction fan is once again reduced to the operating state of, e.g. 260 l/s.

Alternatively, it is also possible to arrange an observation window in the dirt collecting device for a sweeping vehicle or in a vacuum cleaner nozzle, with which the operator can optically control the filling of the intermediate container.

If an energy requirement of 700 watts is assumed for the rotary drive of the sweeper roller, high energy-saving potentials are present. Tests have shown that the operation of a sweeping vehicle in accordance with the method according to the invention only requires 50% of the usual energy of a sweeping vehicle, wherein said required energy translates to approximately 2000 watts of electric power.

This is an enormous advantage when compared to the usual power of suction fans which, for a street sweeper of the type CR2250 (Nilfisk), lies at 7.5 kW.

Therefore, the method according to the invention saves 5.5 kW or 75% of the amount of energy used for the operation of a sweeping vehicle having a dirt collecting device according to the invention.

In terms of the energy consumption of a vacuum cleaner, which is designed either as a floor vacuum cleaner or an upright vacuum cleaner, power of only 250 watts is required for normal operation, and power is only increased occasionally or temporarily to 900 watts for emptying the intermediate container.

The subject matter of the present invention is not only the subject matter of the individual patent claims but also the combinations of individual patent claims.

Any and all information and features disclosed in the documents, including the abstract, particularly the spatial embodiment shown in the drawings are claimed as essential to the invention insofar as they are individually and in combination novel over the prior art.

If subjects are denoted as "essential to the invention" or "important," it does not mean that these subjects must necessarily form the subject matter of an independent claim. This shall be determined solely by the independent claim, as currently worded.

In the following, the invention shall be described in more detail using drawings showing only one embodiment. Further features and advantages essential to the invention can be derived from the drawings and their description.

FIG. 14 shows a table showing the energy consumption of the suction fan of a sweeping vehicle at normal operation and in emptying mode;

FIG. 15 shows a table regarding the time portion of the operation of a sweeping machine relative to the energy consumption.

In the present description of the invention, both the features of a dirt collecting device 2 for a cleaning device, particularly a sweeping vehicle, and the features of a vacuum cleaner nozzle 20 for a floor or upright vacuum cleaner are described; therefore, the same reference signs apply to all parts. For reasons of simplification, no reference was made to the suction fan and a collection container in the description of the operation of a floor or upright vacuum cleaner. The relevant information is part of the disclosure of the aforementioned U.S. Pat. No. 5,500,979 A1. Reference is herewith made to that description.

In particular, FIG. 14 in said document shows a complete depiction of an upright vacuum cleaner having a suction fan, a collection container, and an associated fine mesh filter. All these parts are also parts of the present invention.

Figure 1:
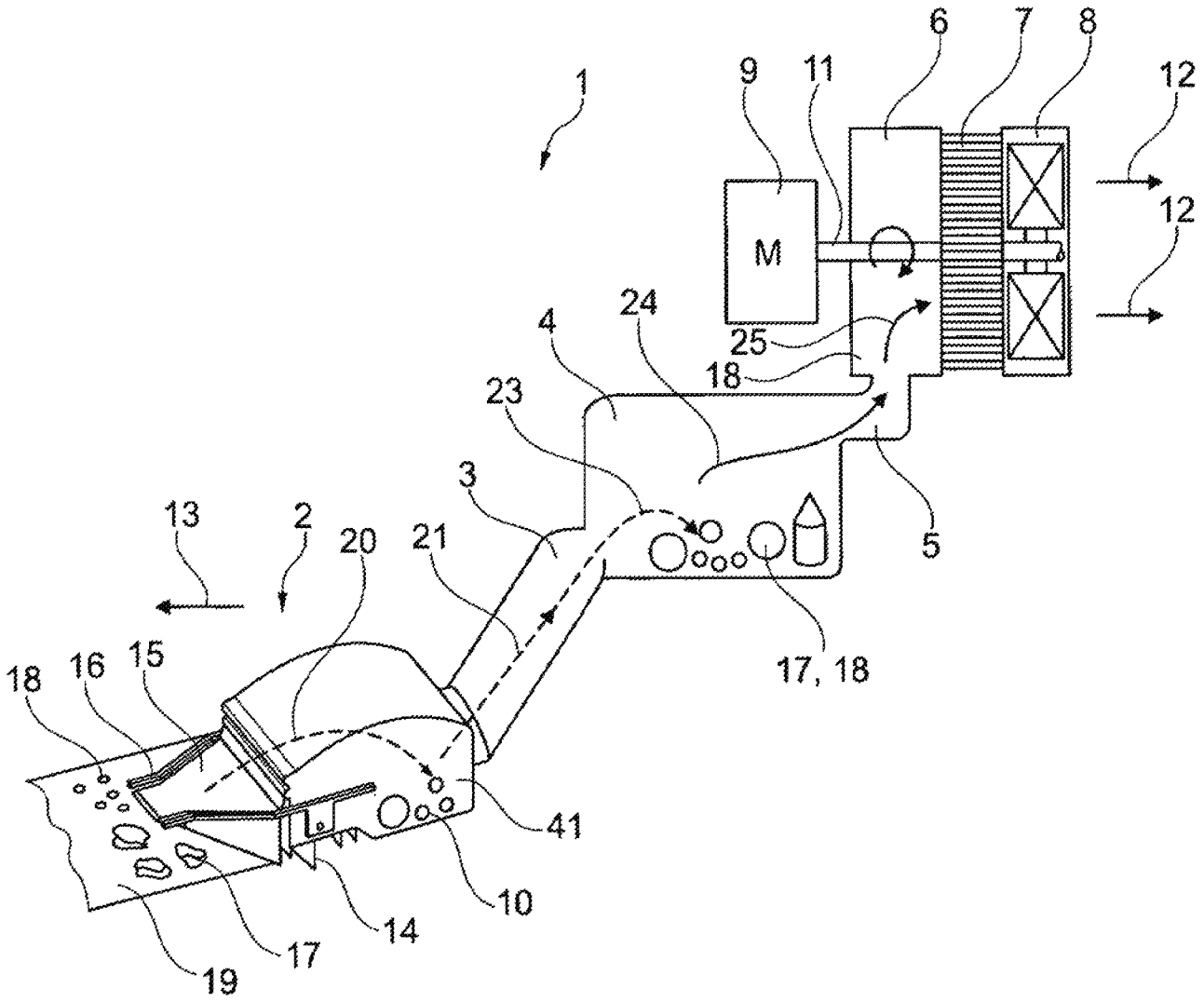
FIG. 1 shows schematically the structure of a sweeping vehicle without chassis or similar parts.

FIG. 1 shows schematically the airflow in a sweeping vehicle which, for example, is described in DE 41 28 879 A1 or EP 2 350 393 B1. All features described therein, particularly chassis, steering, drive, and the like have been omitted in FIG. 1 of the present description of the invention for reasons of simplification.

Accordingly, the sweeping vehicle 1 according to FIG. 1 comprises a dirt collecting device 2 which essentially consists of a housing 26 (see FIG. 2), which, with regard to its cover wall 27, is designed so as to be arch-shaped, and which carries a height-adjustable front spoiler 15 at its front end.

By means of a supporting device (not depicted in FIG. 1), the dirt collecting device 2 according to FIG. 1 is movable over a roadway plane 19, namely by means of the drive of the sweeping vehicle. A rotatingly driven sweeper roller 14 is arranged in the interior of the dirt collecting device 2. During operation of the dirt collecting device 2, the front spoiler 15 is guided in driving direction 13 over the roadway plane 19, and the coarse dirt 17 and possible fine dirt 18 accumulated on said plane is input into the dirt collecting device 2.

It has already been mentioned in the introduction of the description that during normal operation of the dirt collecting device 2, the coarse dirt 17 consists of non-dispersible material, such as stones, bottles, cans, and the like.

However, the fine dirt 18 is immediately input during normal operation of the dirt collecting device 2 and is conveyed in arrow direction 21 to a downstream coarse dirt collection container 4 by means of a connection channel 3.

The outlet of the coarse dirt collection container 4 is connected to a fine dirt collection container 6 by means of a further connection channel 5, and so the fine dirt reaches the filter 7, drops from said filter 7 and is deposited in the fine dirt collection container 6.

Behind the filter 7, a suction fan 8 is arranged which is driven by a motor 9 in a specific rotational direction by means of a driveshaft 11.

The motor can either be an electric drive motor or it can also be derived by means of a coupling and a corresponding intermediate transmission directly from the drive of the sweeping vehicle 1.

The air suctioned by the suction fan 8 in arrow direction 25 over the fine dirt collection container 6 thus flows through the filter 7 and leaves in a cleaned state the outlet of the filter 7 in arrow direction 12.

It has already been pointed out in the general description that the fine dirt collection container 6 can also coincide with the coarse dirt collection container 4, and both containers can form a single container.

However, in the depicted embodiment, the two containers 4, 6 are separate from one another, which has certain operational advantages.

During normal operation, the suction power of the suction fan 8 is reduced such that there is only a reduced airflow in the area of the front side of the front spoiler 15 and in the area of the suction side of the sweeper roller 14, and so with the reduced suction airflow, it is only possible for the sweeper roller 14 to input the coarse dirt 17 from the roadway plane 19 and transport said coarse dirt 17 according to the throw-over principle (or alternatively according to the throw-under principle) in arrow direction 20 to a trough-shaped intermediate container 10, which is open at the top and adjacent to the sweeper roller 14. This is where the coarse dirt is deposited, as is shown in FIG. 1.

However, during normal operation, the input fine dirt 18 is conveyed over the intermediate container 10 in arrow direction 21 either to the coarse dirt collection container 4 and/or the downstream fine dirt collection container 6.

If the filling level in the intermediate container 10, which is monitored by means of a filling level sensor, is so high that it must be emptied, the power of the suction fan 8 is greatly increased and the coarse dirt 17 stored in the intermediate container 10 is made dispersible by said increased suction pressure and transported in arrow direction 21 into the coarse dirt container 4, where it is deposited, as is shown in FIG. 1.

During this emptying mode, the fine dirt, which might still be deposited in the coarse dirt collection container 4, is still transferred to the fine dirt collection container 6.

Therefore, the intermediate container 10 is emptied of the coarse dirt 17, which is now dispersible, in arrow direction 23 into the coarse dirt collection container 4 provided for such purpose. The fine dust possibly still present in the coarse dirt collection container 4 is conveyed further in arrow direction 24 and conveyed in arrow direction 25 against the filter 7, where the fine dirt 18 is separated.

It is not depicted that both the coarse dirt collection container 4 and the fine dirt collection container 6 can be emptied from time to time.

FIGS. 2 to 5 show further details of the dirt collecting device 2 according to the invention.

Figure 2:
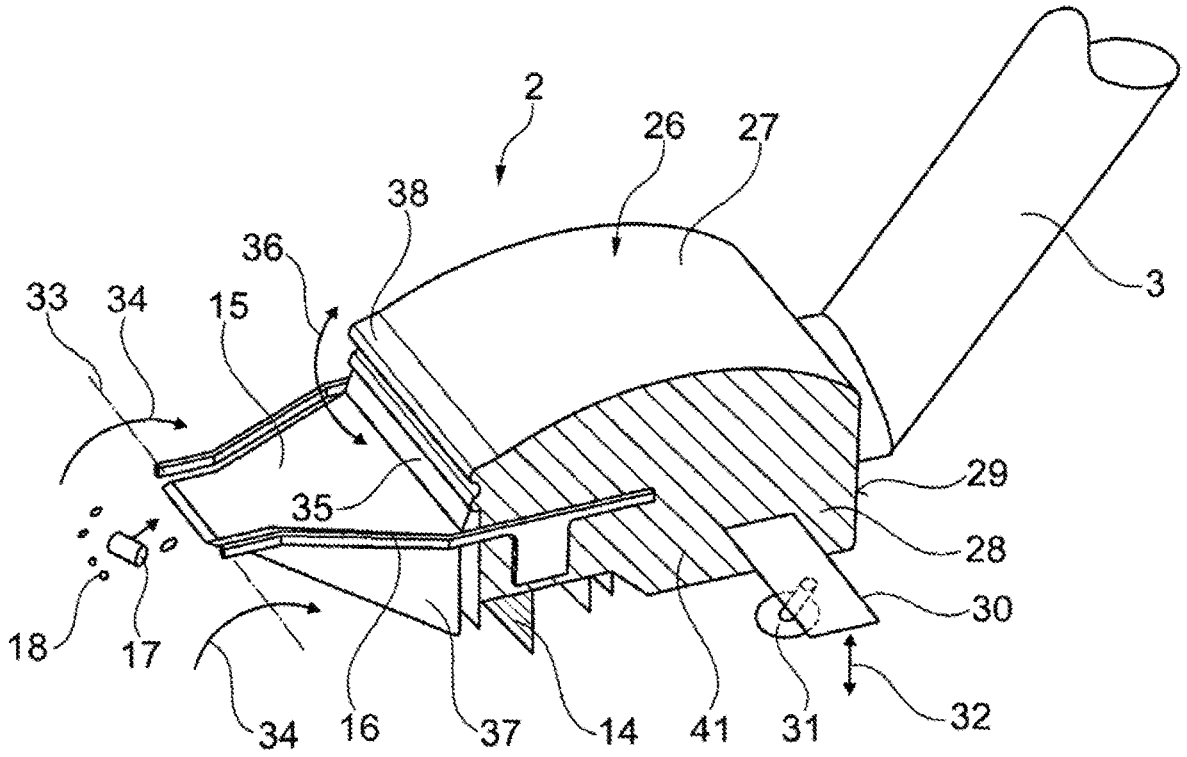
FIG. 2 shows a perspective view of the dirt collecting device for the sweeping vehicle according to FIG. 1.

FIG. 2 shows that additional supporting and drive units 30 can be arranged at the dirt collecting device 2, and so it does not have to be securely attached to the sweeping vehicle 1; it can also be operated separately in driving direction 13 and only be means of a coupling connection with the sweeping vehicle 1.

Furthermore, FIG. 2 shows that in the area of the pivot axis 33, the front spoiler 15 arranged at the front is designed so as to be pivotable in the arrow direction 34 and in the opposite direction thereto, and with sealing lip 35 are provided on the edge of the front spoiler that sealingly bears against the front wall 38, which is associated with the housing 26 of the dirt collecting device 2.

Therefore, the sealing lip 35 of the housing 26, which bears against the front wall 38, is arranged height-adjustably in the arrow directions 36. For that purpose, a rack frame 16 is provided on the side of the housing, and the pivot axis 33 for the pivot mounting of the front spoiler 15 is attached to the free front end of said rack frame 16.

In the area of the suction opening in the front, the front spoiler 15 comprises a cone narrowing 39, and so high air speed is generated in the area of said suction opening, said high air speed being capable of transporting the coarse dirt 17 and the fine dirt 18, accumulated on the roadway plane, at least to the area of operation of the rotatingly driven sweeper roller. The side walls of the front spoiler are supposed to rest on the roadway plane in a preferably sealed manner, or form a slight gap to the roadway plane.

Figure 3:
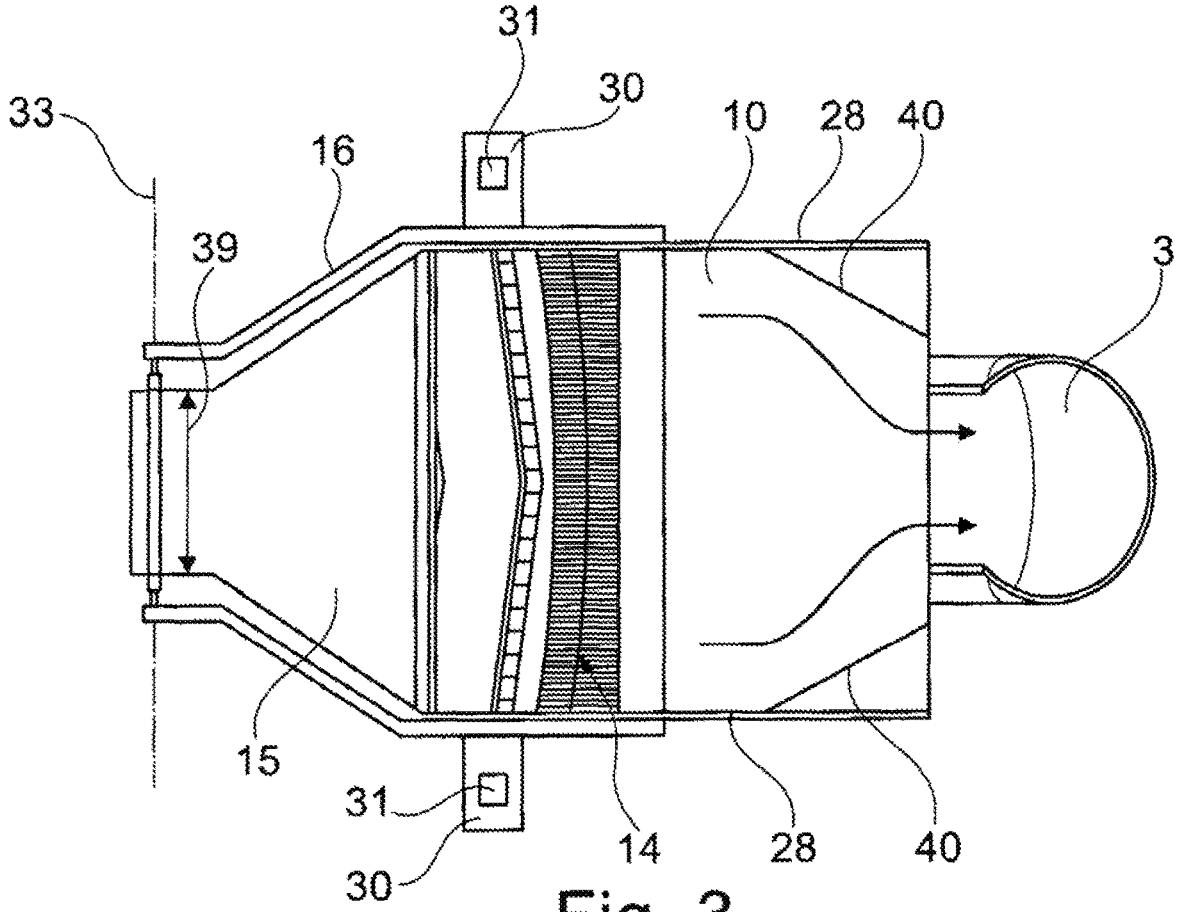
FIG. 3 shows a view from the bottom of the dirt collecting device according to FIG. 1.
Figure 4:
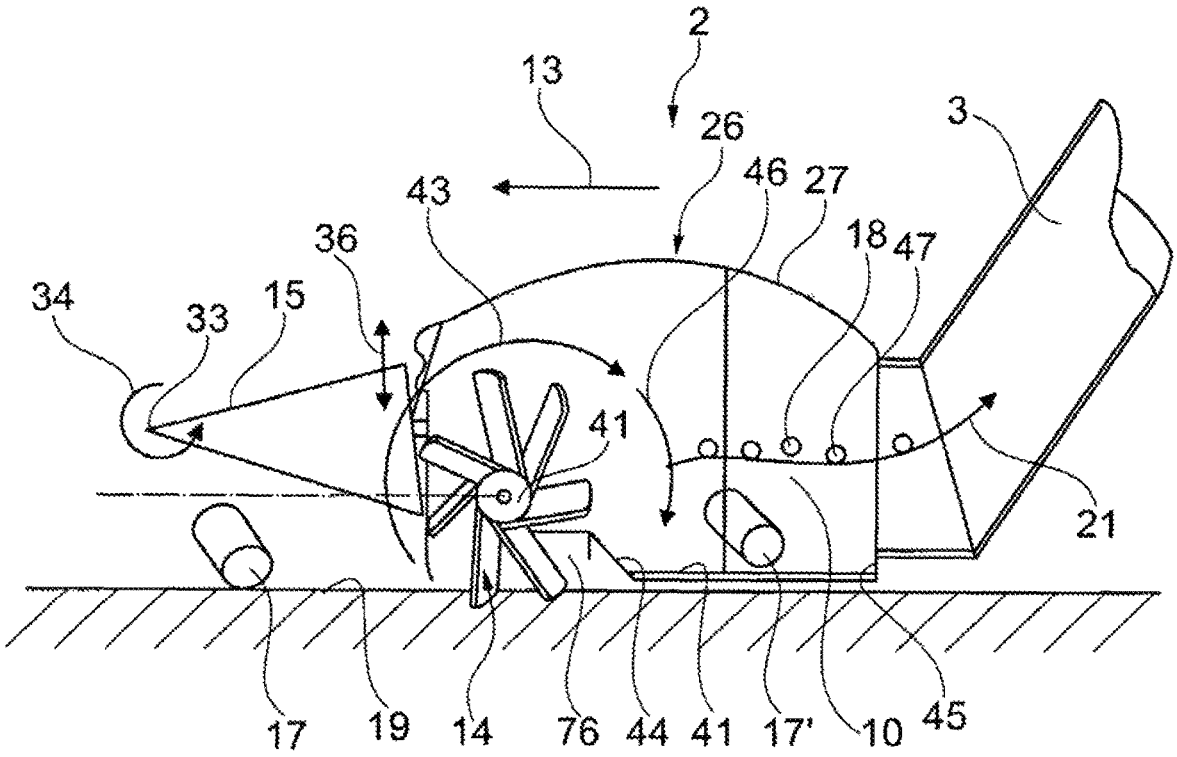
FIG. 4 shows the cross-section of a dirt collecting device according to FIGS. 2 and 3 when absorbing coarse dirt.
Figure 5:
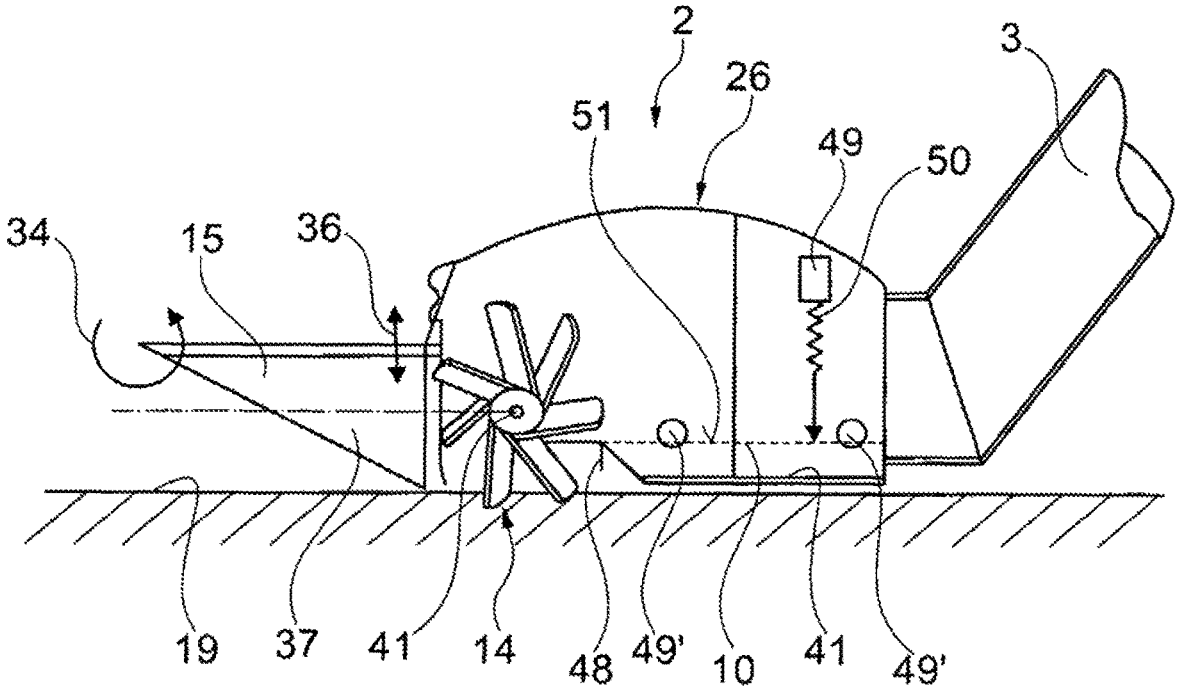
FIG. 5 shows the cross-section of the dirt collecting device according to FIG. 4 when absorbing fine dirt as well as a depiction of further details not yet shown in FIG. 4.

According to FIG. 3, the surface of the front spoiler 15 expands in the direction toward the sweeper roller 14, which thus conveys the collected dirt to an intermediate container 10 arranged in the housing 26 of the dirt collecting device 2, as is shown in FIGS. 4 and 5.

The intermediate container 10 comprises a floor surface 41 which is separated from the area of operation of the sweeper roller 14 only by a cone wall 44 which obliquely slopes toward the rear, and so it is readily possible that the sweeper roller, even at low suction pressure, conveys the coarse dirt 17, according to the throw-over principle in FIG. 4, in arrow direction 43 to the intermediate container 10 arranged in the housing 26.

Generally, the housing 26 comprises a cover wall 27 and two side walls 28 which are parallel to one another and are connected by a rear wall 29 at the rear.

At the front side, a front wall 38 is arranged, and the sealing lip 35 of the front spoiler 15 sealingly bears, height-adjustably in arrow directions 36 (see FIG. 2 and FIG. 4), against said front wall 38.

For receiving the coarse dirt, the front spoiler can thus swivel upward, and the coarse dirt on the roadway plane 19, e.g. a can, is thus conveyed to the area of operation of the sweeper roller 14. The sweeper roller 14 forms a receiving space 76, which narrows toward the bottom, and the suction pressure prevailing during normal operation bears against said receiving space 76.

Essentially, the suction pressure is merely suitable for conveying the fine dirt 18 to the intermediate container 10, and the coarse dirt is essentially also only transported to the area of operation of the sweeper roller 14 and conveyed from there by the sweeper roller 14 in arrow direction 43, according to the throw-over principle, to the intermediate container 10, where the coarse dirt is shown with reference sign 17' in FIG. 4.

Due to the reduced suction pressure during normal operation, the arrow direction 43 (conveying direction of the sweeper roller 14) is thus split or divided because the fine dirt 18 from arrow direction 46 is split, and due to the reduced suction pressure is conveyed through the connection channel 3 at least into the coarse dirt collection container 4.

By contrast, the coarse dirt is deposited in arrow direction 46 on the floor surface 41 of the intermediate container 10.

At the front, the intermediate container is delimited by an obliquely running cone wall 44 (see FIG. 4), wherein the floor surface 41 is designed so as to be approximately parallel to the roadway plane 19 and is closed in the rear by a settling wall 45, and so a sufficiently high filling height of coarse dirt 17 is possible in the intermediate container 10. This is shown in FIG. 5. FIG. 5 schematically shows a maximum filling level 51 in the intermediate container 10, and it further shows that the filling level sensor 49 with its measuring beam 50 scans the surface of the coarse dirt in the intermediate container 10 and generates a signal according to FIG. 8, when the maximum permissible filling level 51 is reached.

Alternatively, such a filling level sensor 49 can also be substituted by horizontally measuring filling level sensors 49' which laterally detect the filling level in the intermediate container 10.

According to the general description, mechanical scanning feelers can also be used.

In conjunction with FIG. 3, FIG. 2 also shows that the support and drive units of the dirt collecting device 2 can also consist of rollers which are designed so as to be vertically height-adjustable in arrow direction 32.

On its sides, the front spoiler 15 also comprises conically expanding side spoilers 37, and the housing 26 of the dirt collecting device 2 is also preferably sealed on the bottom side with regard to the roadway plane 19, or only leaves open a slight gap in order to generate the highest possible suction pressure only in the area of the front spoiler 15, particularly in the area, where the coarse and fine dirt 17, 18 is supposed to be collected.

FIG. 3 further shows that the side boundaries of the intermediate container 10 taper preferably conically in the direction of the suctioning connection channel 3, thus forming cone walls 40.

The sweeper roller 16 is attached to a shaft which is rotatingly driven by a rotary drive (not depicted).

FIG. 5 shows that the receiving space 76 for the operation of the sweeper roller 14 is closed off in the housing 26 by a sealing wall 38 in the rear, and then continues as cone wall 44 facing obliquely toward the rear.

Preferably, however, the fine dirt 18 input into the dirt collection device 2 by the sweeper roller is transported during normal operation in arrow direction 47 and not deposited in the intermediate container 10.

Figure 6:
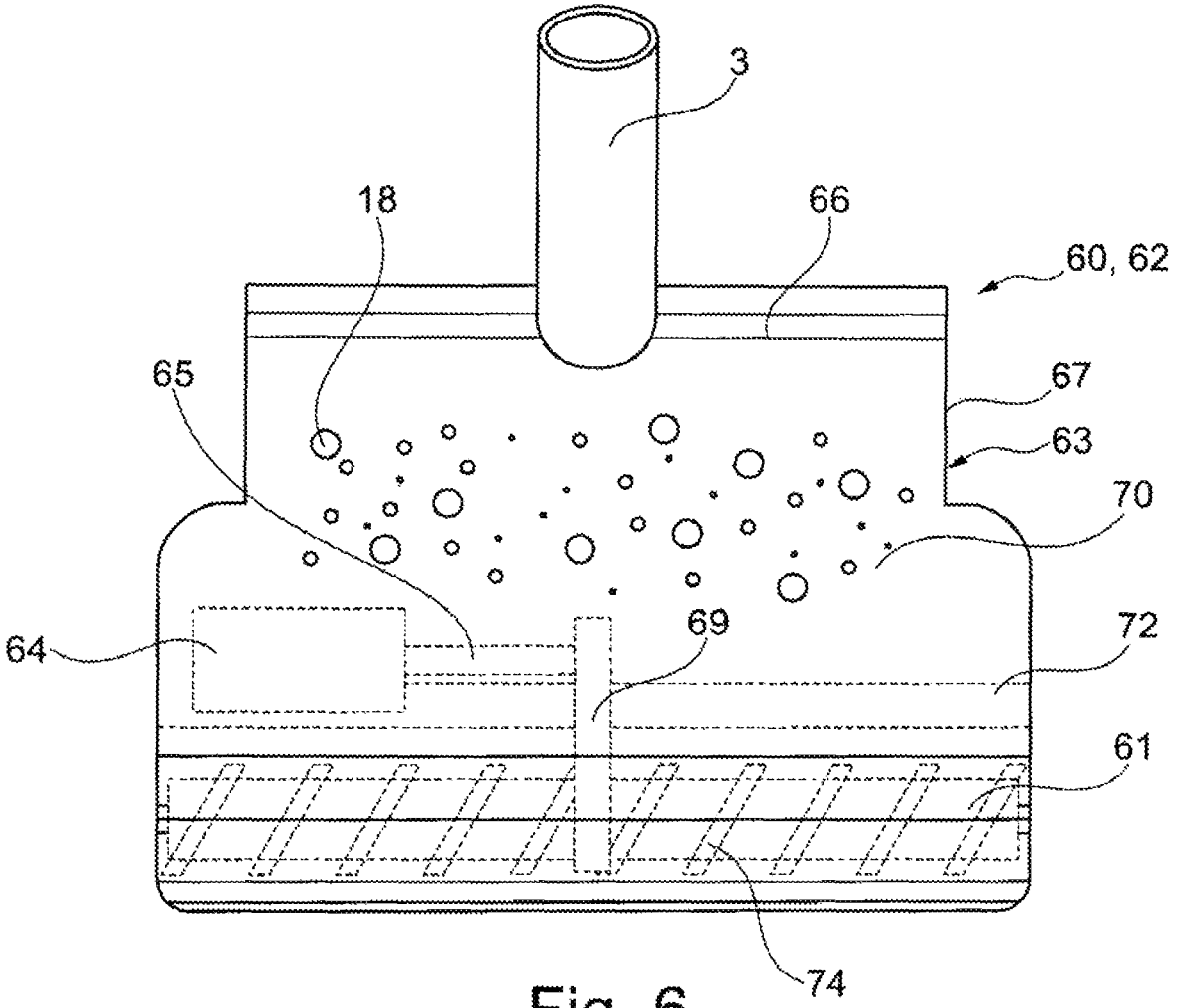
FIG. 6 shows the top view of a vacuum cleaner nozzle with a rotatingly driven brush roller.
Figure 7:
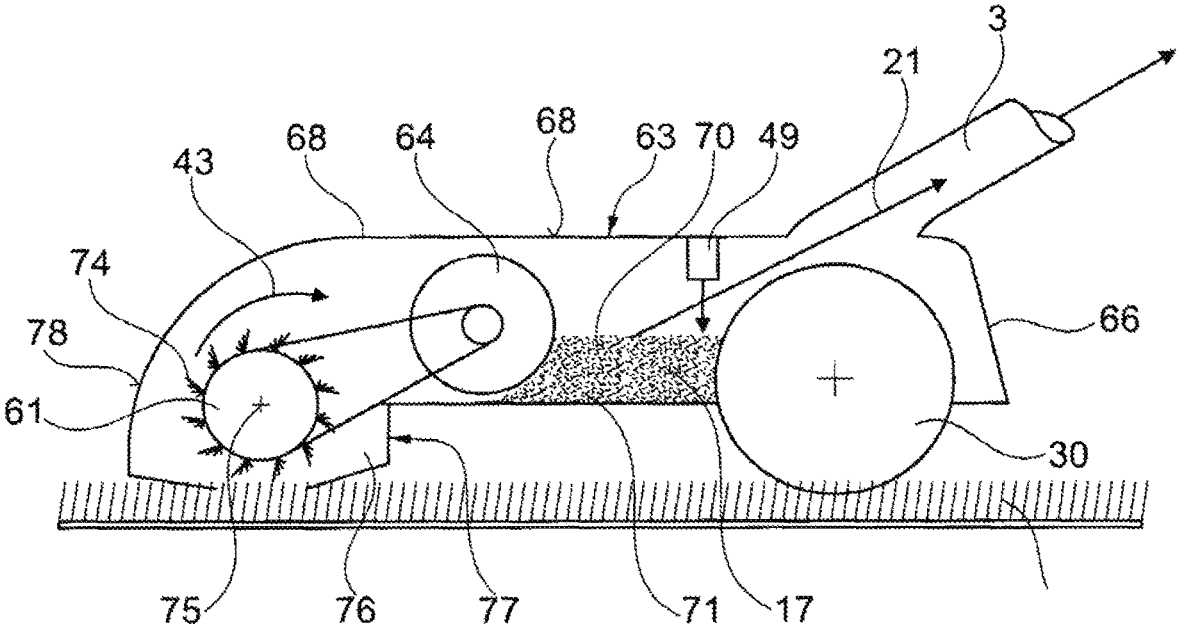
FIG. 7 shows the cross-section of the vacuum cleaner nozzle according to FIG. 6.

FIGS. 6 and 7 show the application of the invention principle on a vacuum cleaner nozzle 60, wherein the description for the dirt collecting device 2 according to FIGS. 1 to 5 similarly applies to the vacuum cleaner nozzle 60.

The vacuum cleaner nozzle 60 shown in the embodiment of FIGS. 6 and 7 refers to an upright vacuum cleaner described, e.g. in U.S. Pat. No. 5,500,979 A1.

The vacuum cleaner nozzle 60 essentially consists of a housing 63, which is closed on all sides, having a rear wall 66 and adjacent side walls 67, wherein the front side of the vacuum cleaner nozzle is closed by means of a front wall 78.

The upper side of the vacuum cleaner nozzle 60 is formed by a closed cover wall 68.

In the front area of the vacuum cleaner nozzle, a brush roller 61 is arranged in the housing 63, said brush roller 61 being driven rotatingly. The brush roller 61 runs essentially perpendicularly to the longitudinal axis through the vacuum cleaner nozzle 60 and is covered with individual brushes 74.

According to FIG. 7, the brush roller 61 operates in a receiving space 76 which is open toward the bottom in the direction of a carpet pile 73. Of course, the carpet pile can be substituted with a hard floor surface.

Therefore, the suction pressure, which is applied by a suction fan (not depicted; see U.S. Pat. No. 5,500,979 A1) and introduced into the housing 63 by means of the connection channel 3, acts into the receiving space 76.

The rotatingly driven brushes 74 therein comb out the hard surface to be cleaned or the carpet pile 73 and convey the accumulated coarse and fine dirt 17, 18 according to the throw-over principle over the brush roller 61 into a downstream intermediate container 70.

The depicted vacuum cleaner nozzle 60 is thus also designed as a dirt collecting device 62 in the same manner as was described using FIGS. 1 to 5 and essentially consists of the rotatingly driven brush roller 61 which conveys the coarse and fine dirt input into the receiving space 76 toward the rear in the housing into an intermediate container 70. The rotary drive of the brush roller 61 is shown in FIG. 6. For this purpose, a motor is used that drives a belt drive 69 by means of its driveshaft 65, said belt drive 69 running over the brush roller 61 and driving it rotatingly.

A shaft 72 is associated with the belt drive 69.

The intermediate container 70 is formed by a floor surface 71 which is divided toward the front by means of an end wall 77. Even though it is not shown in the drawing, it is provided that the end wall 77 is slightly elevated as was described with regard to the cone wall 44 in FIGS. 4 and 5 of the aforementioned embodiment.

Therefore, the intermediate container 70 is designed so as to be trough-shaped and open toward the top, and is provided particularly for receiving coarse dirt 17. In case of vacuum cleaner nozzles 60 of the initially described type, such coarse dirt are, e.g. small pebbles or other non-dispersible objects which cannot be conveyed to the downstream collection container with the low suction pressure applied.

Therefore, at the reduced suction pressure during normal operation, they are deposited in the intermediate container 70, and the filling level in the intermediate container 70 is monitored by a filling level sensor 49.

Once the filling level in the intermediate container 70 has reached a specific filling height, the suction power of the suction fan is increased by two or three times the power applied during normal operation in order to convey the coarse dirt parts deposited in the intermediate container 70 in arrow direction 21 to a downstream collection container (not depicted) on the side of the final storage by means of the connection channel 30.

It is once again provided that even if the low negative pressure present during normal operation is applied, the negative pressure is selected such that the absorbed fine dirt 18 is always conveyed in arrow direction 21 into the downstream collection container (not depicted).

The intermediate container 70 is thus essentially only intended for the intermediate storage of the absorbed coarse dirt 17 which is conveyed by the brush roller 61 in arrow direction 43 into the intermediate container 70.

Figure 8:
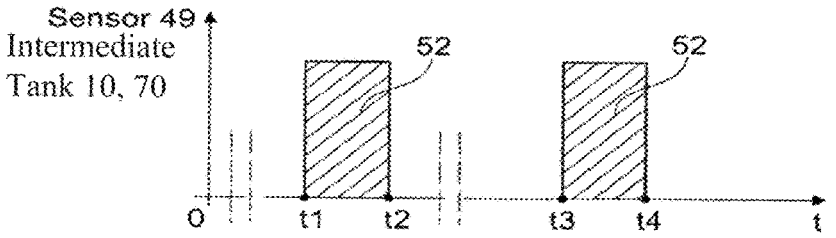
FIG. 8 shows schematically the depiction of the sensor signals of the filling level sensor in the intermediate container according to FIG. 1 or 7.

FIG. 8 shows schematically that the filling level is monitored by the filling level sensor 49 in the intermediate container 10, 70, and when the filling level exceeds a maximum height, a sensor signal 52 is generated in a time period between t1 and t2.

Normal operation takes place in the time period of 0 to t1 and also between t2 and t3.

The time periods for the normal operation between 0 and t1 and t2 and t2 are shown only in a shortened form. In reality, these are time periods which temporally are significantly more drawn out, which is shown with the formulas entered in the drawings. The operating time during normal operation is $t_B$, while the operating time during cleaning operation is $t_C$.

Figure 9:
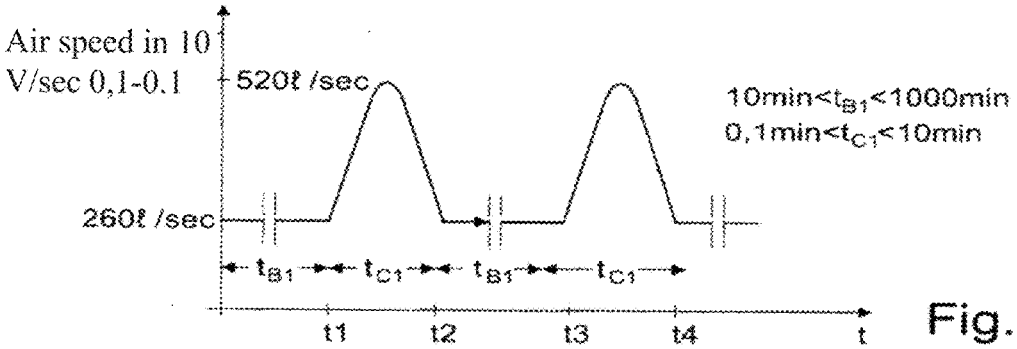
FIG. 9 shows the intermittent air speed in a dirt collecting device for a sweeping vehicle on the basis of the sensor signal of the filling level sensor.

FIG. 9 shows that, on the basis of the sensor signal 52 according to FIG. 8, the air speed of a suction fan 8 in a dirt collecting device 2 for a sweeping vehicle 1 is increased from a normal operation of 260 l/s to, e.g. 560 l/s. During this time, the coarse dirt 17 from the intermediate container 10 becomes dispersible and is removed, and once the filling level sensor 49 has indicated the emptying of the intermediate container 10, the switch back to normal operation with reduced suction pressure takes place at the time t2.

In the time period between t3 and t4, a further cleaning or emptying cycle of coarse dirt 17 from the intermediate container 10 takes place.

Figure 10:
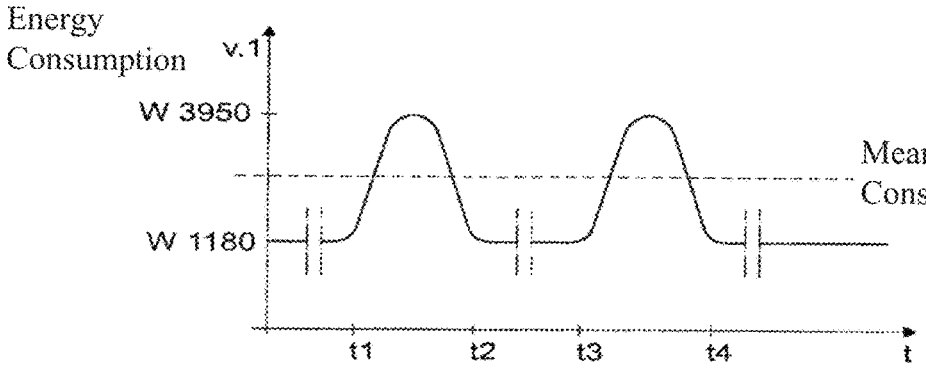
FIG. 10 shows the intermittent energy consumption of the suction fan of a sweeping vehicle.

FIG. 10 shows that due to the increase in the suction pressure in FIG. 5 in emptying mode, the power of the suction fan of approximately 1180 watts (normal operation) must be increased to approximately 3950 watts in order to reach a sufficiently high air speed in the time period between t1 and t2 as well as in the time period between t3 and t4. The dotted line shows the mean energy consumption averaged therefrom.

When compared to the prior art, it is important that in the prior art in FIG. 10, there is a constant maximum energy consumption of the suction fan of 3950 watts, and it is not provided that the energy consumption of the fan is reduced to 1180 watts during normal operation.

It is self-evident that the consumption figures of the energy consumption used herein can vary to a great extent and depend on the power of the suction fan. It is only of importance that during normal operation, the suction fan operates only at a third of the maximum power and that this normal operation is maintained for a very long period of time until the intermediate container 10 is completely filled with coarse dirt 17 and the filling level sensor 49 signals said maximum filling level.

Figure 11:
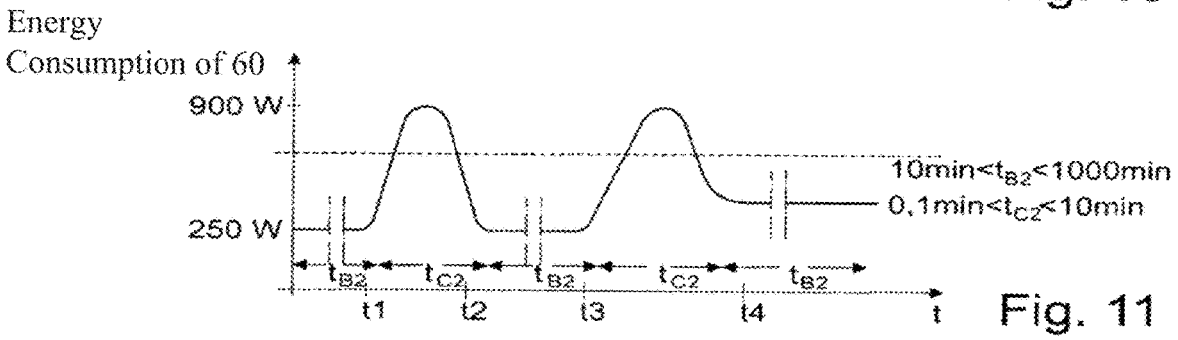
FIG. 11 shows the intermittent energy consumption of the suction fan for a vacuum cleaner.

Analogously, FIG. 11 shows the energy consumption of a suction fan for a vacuum cleaner nozzle 60, also indicating that in the time period between 0 and t1, the suction fan only requires energy of 250 watts, and the suction power is increased to a value of 900 watts only for the emptying of the intermediate container 70 from coarse dirt 17.

It is once again self-evident that the watt figures must be understood to be examples because the ratio between the minimum energy consumption and the maximum energy consumption of the suction fan used is of greater importance.

Figure 12:
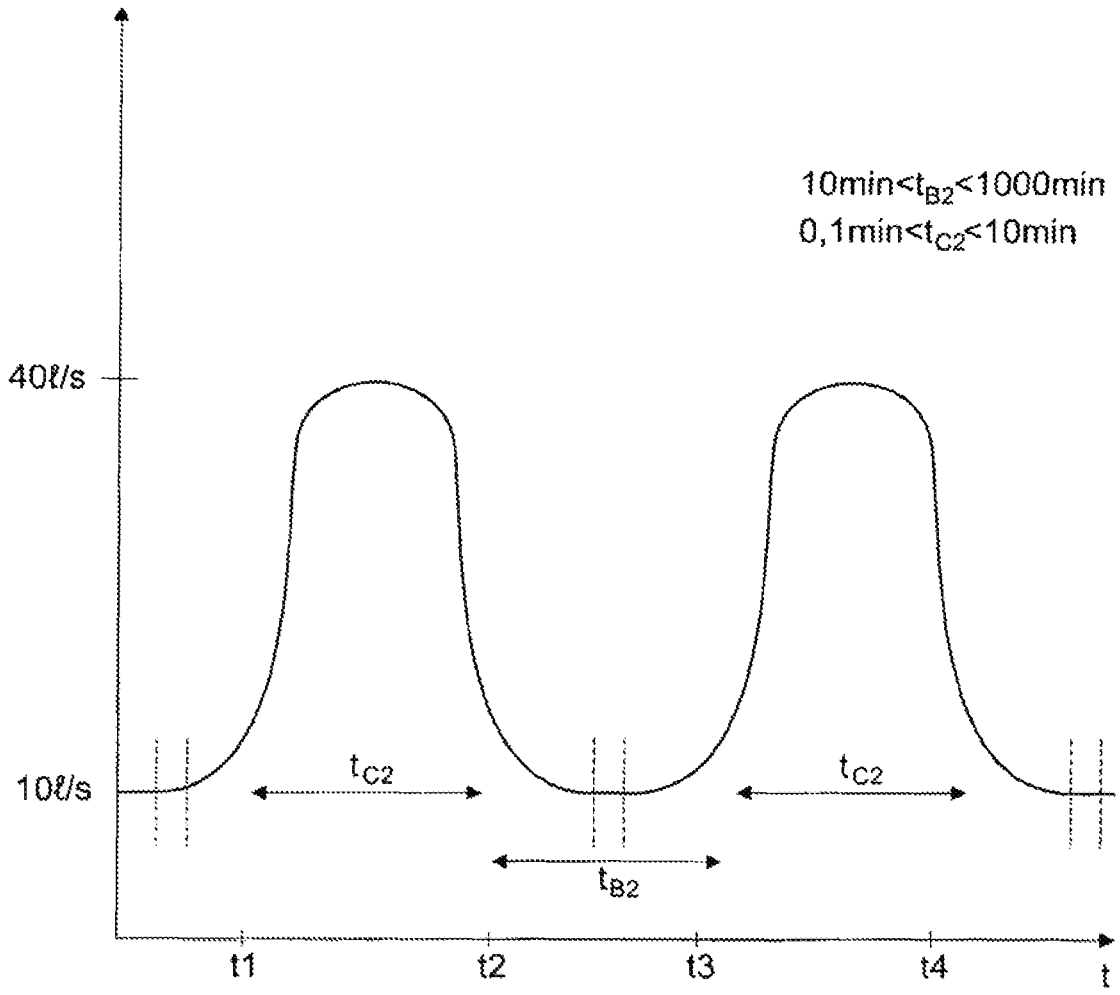
FIG. 12 shows the air speed of a suction fan for a vacuum cleaner during intermittent operation.

Accordingly, FIG. 12 in conjunction with FIG. 11 also shows that during normal operation, a suction airflow of, e.g. 10 l/s is present only in the area of the suction nozzle, while the suction airflow is increased to 40 l/s in emptying mode.

Figure 13:
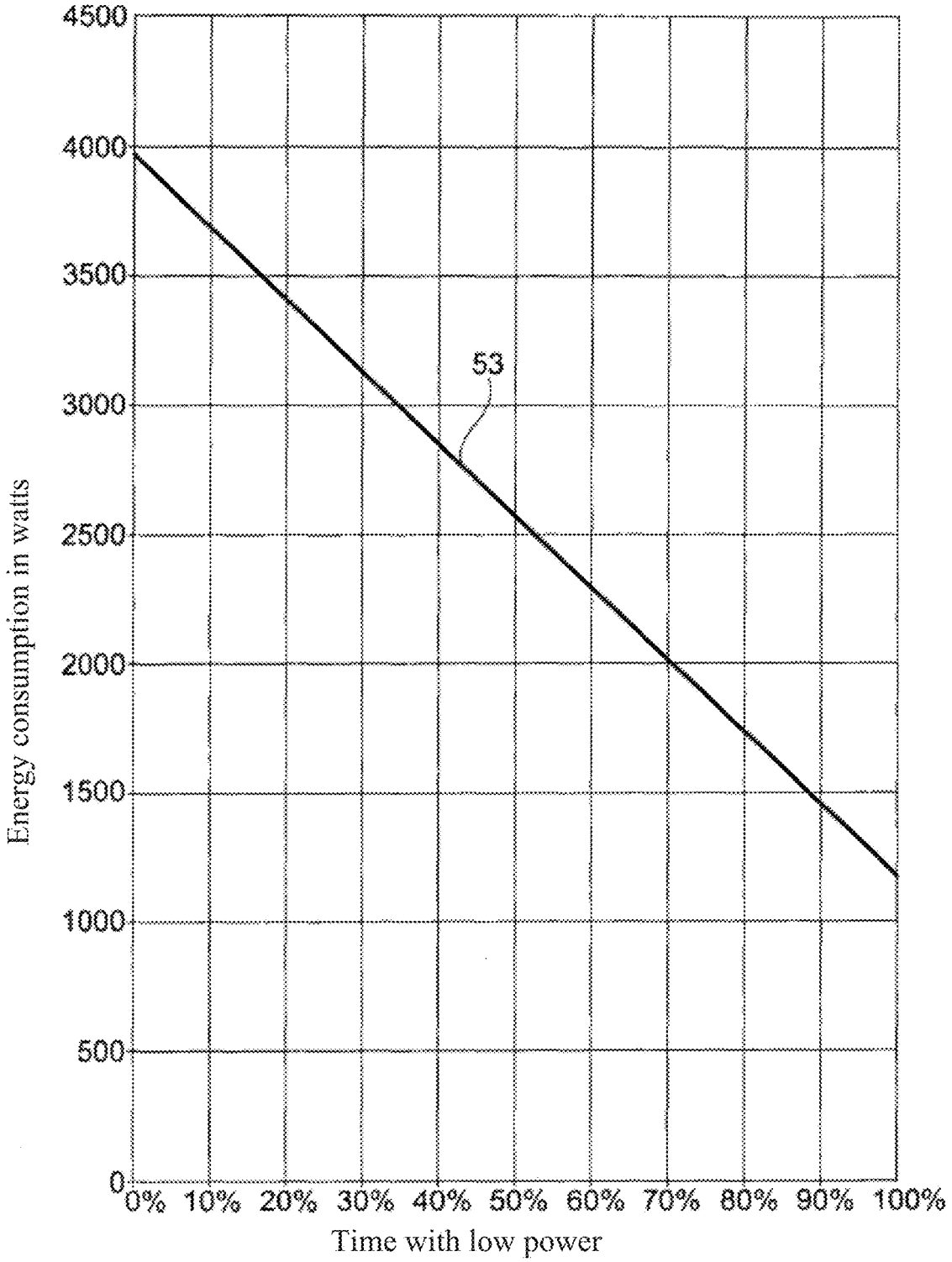
FIG. 13 shows the depiction of the energy consumption of the suction fan of a sweeping vehicle plotted against the percentage of the operating time at low air speed.

FIG. 13 shows that for a sweeping vehicle 1 having a dirt collecting device 2, the suction fan 8 used must be operated with a maximum energy of e.g. 3700 watts for merely, e.g. 10% of the operating time, and is operated for almost 100% of the operating time only at an energy consumption of 1100 watts.

The depicted consumption curve 53 must be understood to be a mere example, and the value figures indicated are only used as an example to illustrate the invention.

The table in FIG. 14 shows that in emptying mode, the suction fan shows an energy consumption of 3269 watts, while during normal operation, the fan only shows an energy consumption of 480 watts, while the brush power of the sweeper roller 14 lies constantly at 700 watts of electrical power.

Therefore, at its peak, an energy consumption of 3969 watts is indicated for the emptying mode, while during normal operation, the suction fan consumes energy of merely 1180 watts.

The table in FIG. 15 shows the time portion of the energy consumption of the suction fan for the dirt collecting device 2 of a sweeping vehicle 1 on the basis of the operating time used. It can be seen that the sweeping vehicle is predominantly operated with a suction fan of reduced power (90% time portion at 1459 watts), and only an emptying time of 10% of the operating time is burdened with an energy consumption of 3690 watts.

REFERENCE SIGNS

1 Sweeping vehicle
2 Dirt collecting device
3 Connection channel
4 Coarse dirt collection container
5 Connection channel
6 Fine dirt collection container
7 Filter
8 Suction fan
9 Motor
10 Intermediate container
11 Drive shaft
12 Arrow direction
13 Arrow direction
14 Sweeper roller
15 Front spoiler
16 Rack frame
17 Coarse dirt
18 Fine dirt
19 Roadway plane
20 Arrow direction
21 Arrow direction
22 Arrow direction
23 Arrow direction
24 Arrow direction
25 Arrow direction
26 Housing
27 Cover wall
28 Side wall
29 Rear wall
30 Support and drive unit
31 Roller
32 Arrow direction
33 Pivot axis
34 Arrow direction
35 Sealing lip
36 Arrow direction
37 Side spoiler (from 15)
38 Front wall
39 Cone narrowing
40 Cone wall (from 10)
41 Floor surface (from 10)
42 Shaft (from 10)
43 Arrow direction
44 Cone wall (from 10)
45 Settling wall (from 10)
46 Arrow direction
47 Arrow direction
48 Sealing wall
49 Filling level sensor 49'
50 Measuring beam
51 Filling level
52 Sensor signal
53 Consumption curve
54 —
55 —
56 —
57 —
58 —
59 —
60 Vacuum cleaner nozzle
61 Brush roller
62 Dirt collecting device
63 Housing
64 Motor
65 Drive shaft
66 Rear wall
67 Side wall
68 Cover wall
69 Belt drive

70 Intermediate container
71 Floor surface
72 Shaft
73 Carpet pile
74 Brush (from 61)
75 Rotational axis
76 Receiving space (for brush roller)
77 End wall
78 Front wall

The invention claimed is:

1. A dirt collecting device for a cleaning device, consisting of:

a housing which is slidable over a floor plane, a suction fan configured to operate in variable speeds at variable power levels, a collection container connected to the housing, at least one rotatingly driven sweeper roller or brush roller arranged in the housing which inputs the coarse and fine dirt from the floor plane into the housing and, supported by a suction airflow of the suction fan, conveys the suction airflow into the collection container, an intermediate container configured to be emptied by operation of the suction fan, the intermediate container comprises a front wall, a rear settling wall, and two side boundaries between the front wall and the rear settling wall, and the intermediate container is disposed in the suction airflow of the suction fan between the at least one rotatingly driven sweeper roller and the collection container and arranged in the housing of the dirt collecting device for temporary intermediate storage of coarse dirt, the collection container arranged downstream of the intermediate container, a suctioning connection channel connected between the intermediate container and the collection container, and a sensor electrically connected to the suction fan and arranged in the intermediate container, to detect a filling level of the input coarse dirt in the intermediate container and to generate a sensor signal that is sent to the suction fan when the filling level exceeds a maximum permissible filling level, wherein the two side boundaries of the intermediate container taper inwardly between the front wall and the rear settling wall toward the suctioning connection channel, wherein the settling wall extends between a floor of the intermediate container and an inlet opening of the suctioning connection channel and has a height that is less than a height of the front wall, wherein the suction fan is configured to operate in the following modes:

a normal operation, responsive to absence of the generated sensor signal indicating that the maximum permissible filling level of the intermediate container is not exceeded, in which the suction power of the suction fan is set at a low level such that the suction pressure in the dirt collecting device is merely sufficient to convey and deposit the input coarse dirt into the intermediate container, and to convey the input fine dirt into the collection container; and an emptying mode, responsive to the generated sensor signal indicating that the maximum permissible filling level in the intermediate container is exceeded, in which the suction power of the suction fan is increased such that the input coarse dirt, which is temporarily deposited in the intermediate container, becomes dispersed and is conveyed from the intermediate container into the collection container to thereby empty the intermediate container.

2. The dirt collecting device according to claim 1, wherein the cleaning device is a sweeping vehicle.

3. The dirt collecting device according to claim 1, wherein the collection container comprises a coarse dirt collection container and a downstream fine dirt collection container, the coarse dirt collection container being in a hermetically-sealed connection with the downstream fine dirt collection container.

4. The dirt collecting device according to claim 1, wherein the intermediate container is arranged in driving direction of the cleaning device behind the sweeper roller and forms a box which lies in the suction airflow of the suction fan, the box having an inlet opening and an outlet opening to let airflow and coarse dirt enter and pass through the box.

5. The dirt collecting device according to claim 1, further comprising a front spoiler connected to a front of the dirt collecting device to direct the coarse and fine dirt from the floor plane into the dirt collecting device.

6. The dirt collecting device according to claim 5, wherein the front spoiler is arranged pivotably around a horizontal pivot axis, the horizontal pivot axis being transverse to a dirt conveying direction of the dirt collecting device and parallel to the floor plane, and, the front spoiler comprises a narrowed section having a first end and a second end, and a widening portion that widens from the second end of the narrowed section towards the at least one sweeper roller.

7. The dirt collecting device according to claim 1, the cleaning device is a floor or upright vacuum cleaner, and the housing is a vacuum cleaner nozzle.

8. The dirt collecting device according to claim 7, wherein the brush roller is arranged in a receiving space, which is sealed on all sides and only open on the bottom side, and where the brush roller inputs the coarse and fine dirt and conveys the coarse and fine dirt to the hermetically-sealed downstream intermediate container, and the fine dirt is conveyed by the suction airflow of the suction fan to the collection container serving as a final storage.

9. A method for operating a dirt collecting device for a sweeping vehicle or for a vacuum cleaner nozzle of a floor or upright vacuum cleaner, the method comprising:

in a first method step, providing the dirt collecting device consisting of a housing which is slidable over a floor plane, a suction fan configured to operate in variable speeds at variable power levels, a collection container connected to the housing, at least one rotatingly driven sweeper roller or brush roller arranged in the housing which inputs the coarse and fine dirt from the floor plane into the housing and, supported by a suction airflow of the suction fan, conveys the suction airflow into the collection container, an intermediate container configured to be emptied by operation of the suction fan, the intermediate container comprises a front wall, a rear settling wall, and two side boundaries between the front wall and the rear settling wall, and the intermediate container is disposed in the suction airflow of the suction fan between the at least one rotatingly driven sweeper roller and the collection container and arranged in the housing of the dirt collecting device for temporary intermediate storage of coarse dirt, the collection container arranged downstream of the intermediate container, a suctioning connection channel connected between the intermediate container and the collection container, and a sensor electrically connected to the suction fan and arranged in the intermediate container, to detect a filling level of the input coarse dirt in the intermediate container and to generate a sensor signal that is sent to the suction fan when the filling level exceeds a maximum permissible filling level, wherein the two side boundaries of the intermediate container taper inwardly between the front wall and the rear settling wall toward the suctioning connection channel, wherein the settling wall extends between a floor of the intermediate container and an inlet opening of the suctioning connection channel and has a height that is less than a height of the front wall, wherein the suction fan is configured to operate in the following modes: 1) a normal operation, responsive to absence of the generated sensor signal indicating that the maximum permissible filling level of the intermediate container is not exceeded, in which the suction power of the suction fan is set at a low level such that the suction pressure in the dirt collecting device is merely sufficient to convey and deposit the input coarse dirt into the intermediate container, and to convey the input fine dirt into the collection container; and 2) an emptying mode, responsive to the generated sensor signal indicating that the maximum permissible filling level in the intermediate container is exceeded, in which the suction power of the suction fan is increased such that the input coarse dirt, which is temporarily deposited in the intermediate container, becomes dispersed and is conveyed from the intermediate container into the collection container to thereby empty the intermediate container, in a second method step, which correspond to the normal operation, the suction power of the suction fan is set at such a low level that the suction pressure in the dirt collecting device or the vacuum cleaner nozzle is merely sufficient to convey and deposit the absorbed coarse dirt into the intermediate container, and to convey the absorbed fine dirt into a downstream collection container;

in a third method step, the filling level in the intermediate container is detected with respect to the coarse dirt deposited therein;

in a fourth method step, which corresponds to the emptying mode, if the filling level in the intermediate container is exceeded, the suction power of the suction fan is increased such that the coarse dirt, which is temporarily deposited in the intermediate container, becomes dispersible and is conveyed into the downstream collection container.

10. The method according to claim 9, wherein for the operation of a dirt collecting device for a sweeping vehicle, the energy consumption of the suction fan is approximately doubled from the first method step (normal operation) to the second method step (emptying mode).

11. The method according to claim 9, wherein for the operation of a vacuum cleaner nozzle, the energy consumption of the suction fan is approximately tripled from the first method step (normal operation) to the second method step (emptying mode).

12. The method according to claim 9, wherein the surface located in the suction airflow of the suction fan of the dirt collecting device for a sweeping vehicle is in a range between 20 to $100\times10^{-3}$ m2, and the same surface of the vacuum cleaner nozzle is in a range between 1 to $5\times10^{-3}$ m2.

* * * * *